US006318609B1

(12) United States Patent
Swierz

(10) Patent No.: US 6,318,609 B1
(45) Date of Patent: Nov. 20, 2001

(54) SHOULDER STRAP PAD

(76) Inventor: Jeffrey A. Swierz, One River Dr., Merritt, MI (US) 49667

( * ) Notice: Subject to any disclaimer, the term of this patent is extended or adjusted under 35 U.S.C. 154(b) by 0 days.

(21) Appl. No.: 09/415,989

(22) Filed: Oct. 12, 1999

(51) Int. Cl.[7] ..... A45F 3/14

(52) U.S. Cl. ..... 224/264; 2/460; 224/907; D3/327

(58) Field of Search ..... 224/264, 643, 224/907; 2/455, 459, 460; D3/327

(56) References Cited

U.S. PATENT DOCUMENTS

| | | | | |
|---|---|---|---|---|
| D. 424,301 | * | 5/2000 | Swierz | D3/327 |
| 2,699,550 | * | 1/1955 | Freid | 2/460 |
| 2,823,383 | * | 2/1958 | Crawford | 2/460 |
| 3,799,413 | | 3/1974 | McBain . | |
| 4,040,147 | | 8/1977 | King . | |
| 4,575,874 | | 3/1986 | Johnson . | |
| 4,879,768 | | 11/1989 | McClees et al. . | |
| 4,887,318 | | 12/1989 | Weinreb . | |
| 5,129,101 | | 7/1992 | Douglas . | |
| 5,159,715 | | 11/1992 | Jurga et al. . | |
| 5,250,345 | | 10/1993 | Chu . | |
| 5,441,188 | | 8/1995 | Rosenstein . | |
| 5,507,422 | | 4/1996 | Shields . | |
| 5,590,826 | * | 1/1997 | Endo | 224/264 |

FOREIGN PATENT DOCUMENTS

| | | | | |
|---|---|---|---|---|
| 767014 | * | 1/1957 | (GB) | 224/264 |

* cited by examiner

*Primary Examiner*—Stephen P. Garbe
*Assistant Examiner*—Joseph C. Merek
(74) *Attorney, Agent, or Firm*—Reising, Ethington, Barnes, Kisselle, Learman & McCulloch, P.C.

(57) ABSTRACT

The shoulder strap pad has a base with an inside edge, an outside edge, a top surface and a bottom surface. A plurality of shoulder engaging projections project downwardly from the bottom surface. A plurality of spaced apart ribs extend upwardly from the top surface of the base. Each rib is transverse to the inside and outside edges of the base and has a short inside end height and a tall outside end height. A concave rib surface extends from the short inside end to the tall outside end. An outside strap retaining projection extends upward from the outside end of the concave rib surface. An inside strap retaining projection extends upward from the inside end of the concave rib surface.

8 Claims, 4 Drawing Sheets

FIG-3
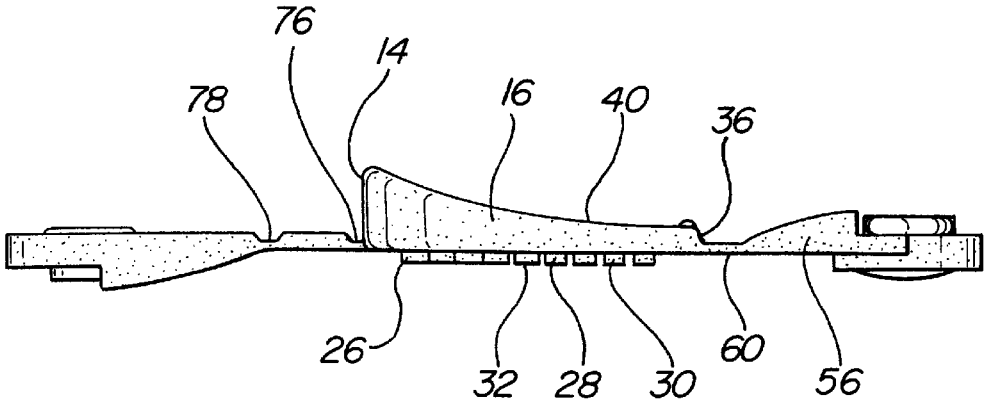
FIG-4
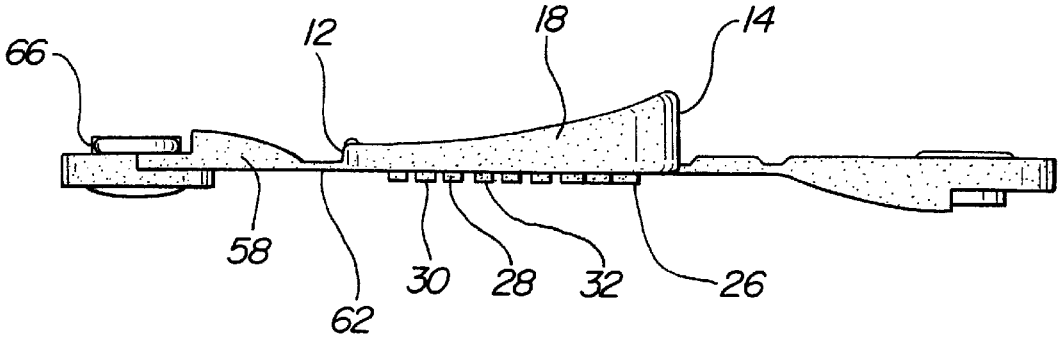
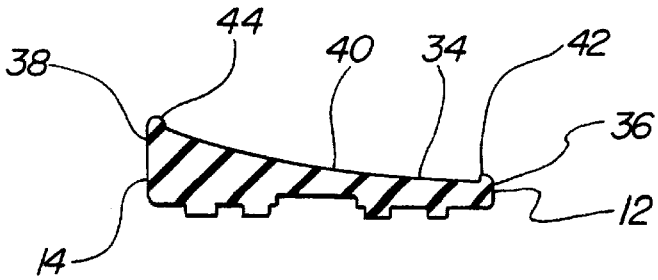
FIG-7

SHOULDER STRAP PAD

FIELD OF THE INVENTION

This invention relates to a shoulder strap pad for holding a shoulder strap and cushioning a shoulder strap and more particularly to a shoulder strap pad that resists slipping relative to a shoulder and that holds a shoulder strap in place.

BACKGROUND OF THE INVENTION

Wedge shaped shoulder pads are used on shoulder straps to cushion straps that do not conform to the slope of a person's shoulder. Most individuals have shoulders that slope downwardly and outward from their neck. Shoulder straps are generally straight straps that tend to extend horizontally at the top of the loop that passes over a person's shoulder. This results in the inside edge of a shoulder strap exerting more pressure on a person's shoulder than the center portion or the outside edge of a shoulder strap. This concentration of pressure makes it uncomfortable to carry a bag or a piece of equipment with a shoulder strap. If the bag or equipment is heavy, the concentration of pressure may become painful in a short period of time.

Straight shoulder straps also tend to slide off a person's shoulder. With the outside edge of a shoulder strap being lightly loaded, the strap tends to slide down a sloping shoulder. To keep the strap from falling off a person has to move the strap back toward their neck periodically.

Wedge shaped shoulder pads have been proposed to evenly distribute the pressure and reduce sliding. These pads distribute the load more evenly when the shoulder strap is centered on the pad. The pad can however slide off a person's shoulder. The shoulder strap can also slide off the shoulder pad.

Shoulder pads have been attached to the shoulder straps by a variety of retainers. These retainers can break. Some of the retainers have also allowed shoulder pads to slide out from under the shoulder strap.

SUMMARY OF THE INVENTION

The shoulder strap pad has a generally rectangular base with an inside edge, an outside edge, a front end, a rear end, a top surface, and a bottom surface. A plurality of spaced apart projections are integral with the base and project downwardly from the bottom surface. Free ends of the plurality of spaced apart projections have flat surfaces.

A plurality of spaced apart ribs are integral with the base and project upwardly from the top surface of the base. Each of the ribs has a short inside edge, a tall outside height and an upper rib surface. The upper rib surface is concave. An inside strap retaining projection extends upward from an inside portion of the upper rib surface. An outside strap retaining projection extends upward from an outside portion of the upper surface. One or more shoulder strap pad holders holds the shoulder pad on a shoulder strap.

The spaced apart projections on the bottom of the rectangular base tend to limit movement of the base relative to a person's shoulder. The spaced apart ribs with a concave surface, an inside strap retaining projection and an outside strap retaining projection hold a shoulder strap centered on the upper concave surface of the ribs.

BRIEF DESCRIPTION OF THE DRAWINGS

The presently preferred embodiment of the invention is disclosed in the following description and in the accompanying drawings, wherein:

FIG. 3 is a rear end elevational view thereof;

FIG. 4 is a front end elevational view thereof;

FIG. 7 is a sectional view taken along lines 7—7 in FIG. 5.

DESCRIPTION OF THE PREFERRED EMBODIMENT

Figure 1:
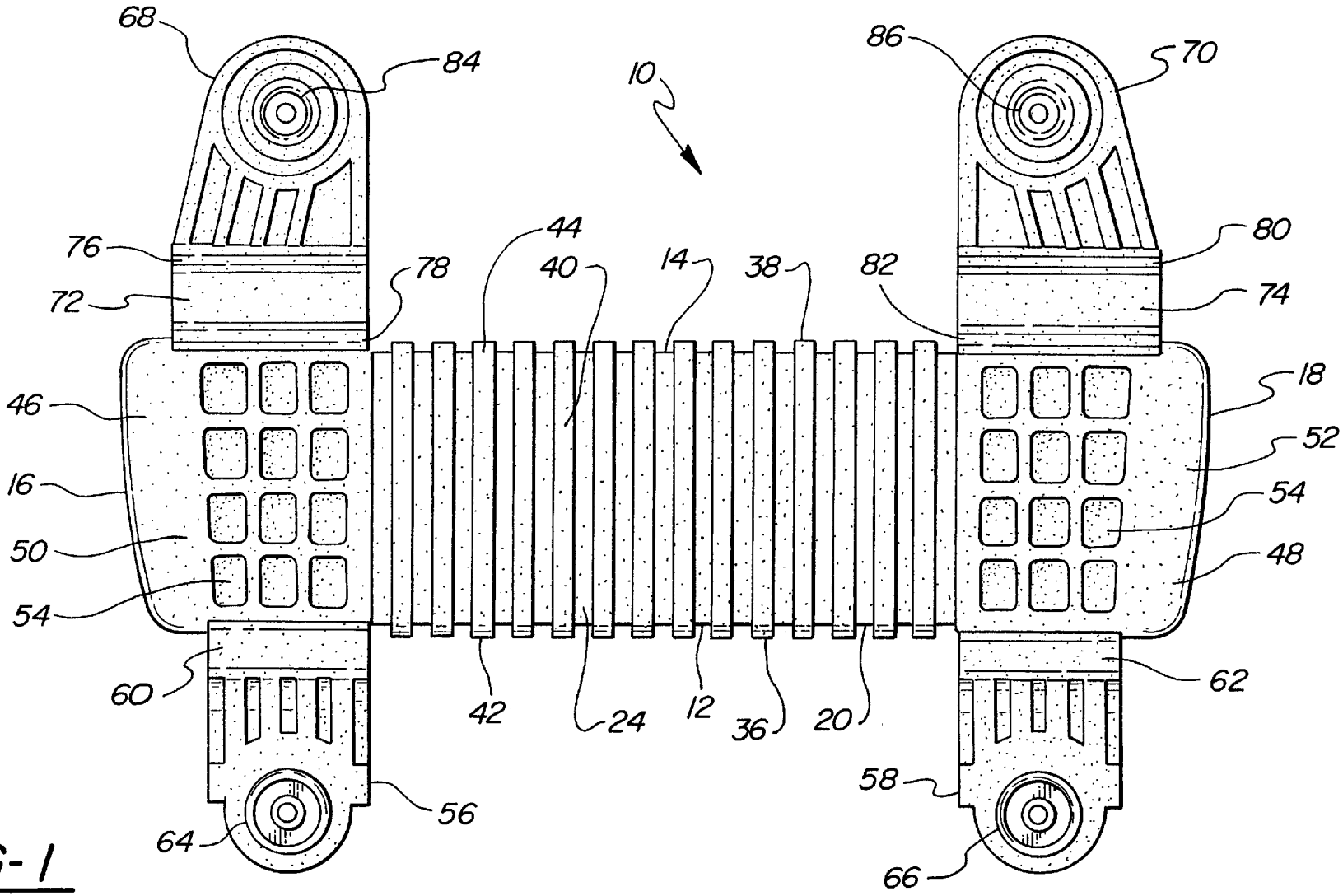
FIG. 1 is a top plan view of the shoulder strap pad.

The shoulder strap pad 10 is a generally rectangular member with an inside edge 12, an outside edge 14, a front end 16 and a rear end 18. A base 20 extends from the inside edge 12 to the outside edge 14 and from the front end 16 and to the rear end 18. The base 20 also has a bottom surface 22 and a top surface 24.

A plurality of spaced apart cylindrical projections 26, 28, and 30 are integral with the base 20 and extend axially downward from the bottom surface 22. The cylindrical projections 26, in two rows parallel to and adjacent to the outside edge 14, are relatively large in diameter. The cylindrical projections 30, in two rows parallel to and adjacent to the inside edge 12, are relatively small in diameter. Cylindrical projections between 28 in the five center rows have an intermediate diameter. All of the cylindrical projections 26, 28 and 30 have free end surfaces 32 that are generally flat and spaced from the bottom surface 22 and equal distance less than a diameter of the cylindrical projections 26. The diameters and the heights of the cylindrical projections are not too critical. However, these projections 26, 28 and 30 should be relatively stiff. Adequate cylindrical projection stiffness is obtained with relatively flexible material if the height of the cylindrical projections 26, 28 and 30 is about ½ the diameter of the smallest cylindrical projections 30. The edges of the cylindrical projections 26, 28 and 30 provide substantial holding power and normally keep the shoulder strap pad 10 from sliding off a person's shoulder. When the shoulder strap pad 10 is used by a person wearing a heavy sweater or other relatively thick clothing material, it may be desirable to increase the height and diameter of the cylindrical projections 26, 28 and 30.

Figure 2:
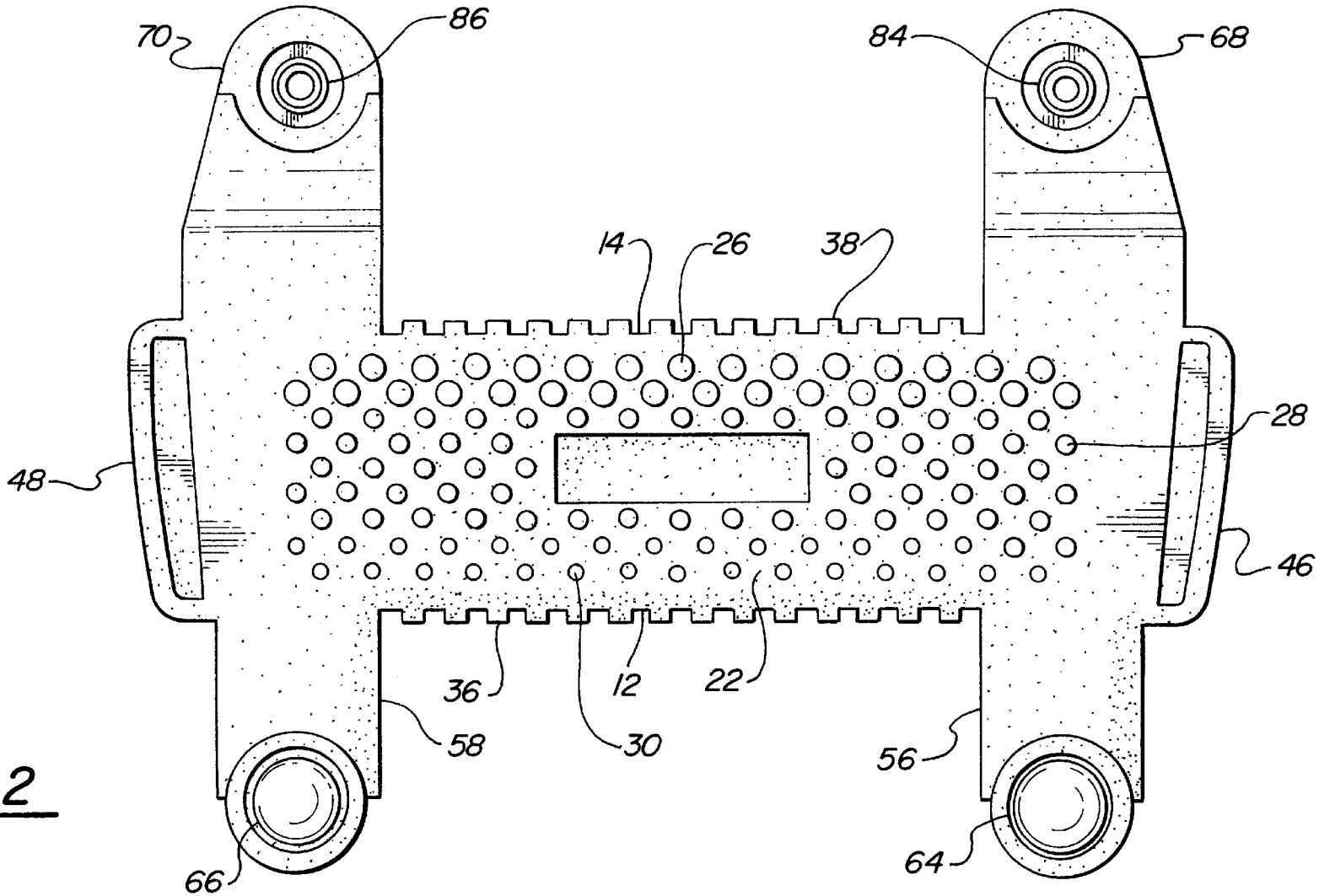
FIG. 2 is a bottom view thereof.
Figure 5:
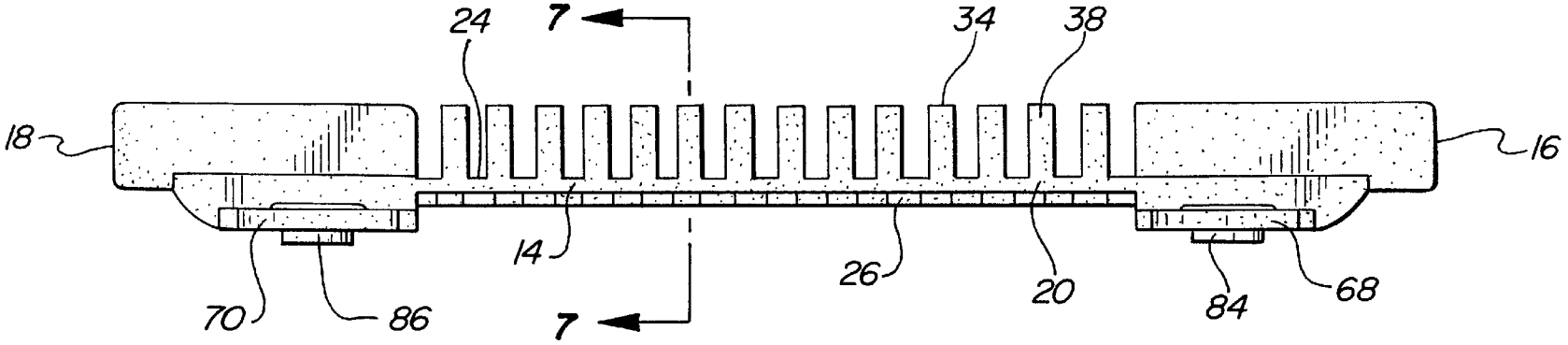
FIG. 5 is an outside side elevational view thereof.
Figure 6:
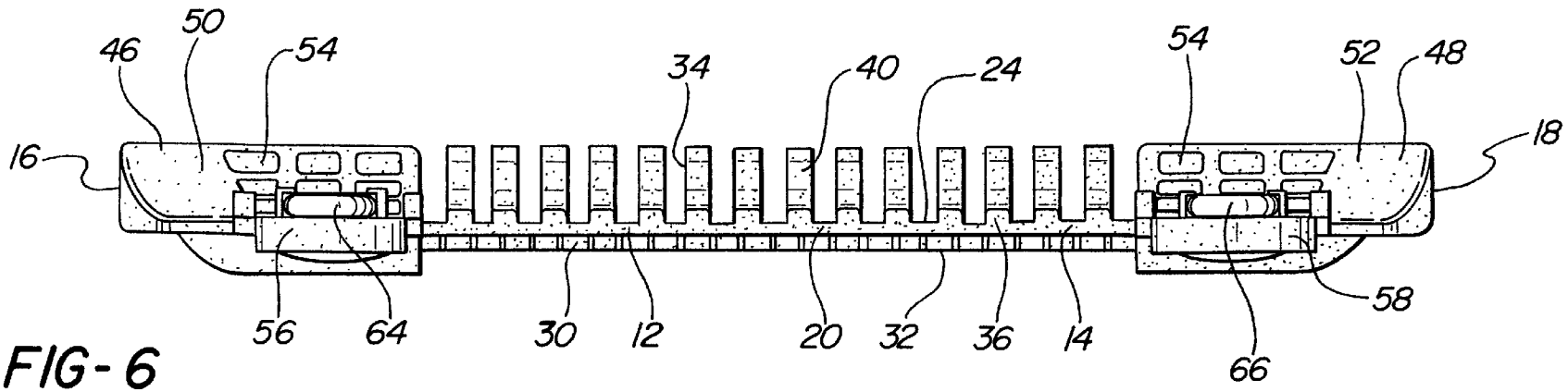
FIG. 6 is an inside elevational view thereof.

A plurality of spaced apart parallel ribs 34 are integral with the base 20 and extend upwardly from the top surface 24. Each rib 34 extends from the inside edge 12 to the outside edge 14 of the base 20. As shown in FIGS. 1 and 2, the ribs 34 extend a little past the base 20. The ribs 34 could also end a little short of the inside edge 12 and the outside edge 14 if desired.

Each rib 34 has an inside edge 36 and an outside edge 38. The inside edge 36 extends up to a position that is slightly above the top surface 24 of the base 20. The outside edge 38 extends upward from the top surface 24 of the base 20 a distance that makes a line through the top of the inside edge 36 and the outside edge 38 horizontal when the bottom surface 22 of the base 20 under the rib 34 is in contact with the top of an average person's shoulder.

The top surface 40 of each rib 34 is a concave surface and is an arc about an axis that is above the top surface 24 of the base 20 as well as above the ribs 34. An inside strap retaining projection 42 extends upward from the top arcuate surface 40 on each rib 34 adjacent to the inside edge 36. An outside strap retaining projection 44 extends upward from the top arcuate surface 40 of each rib 34 adjacent to the outside edge 38.

Blocks 46 and 48 are integral with the ends of the base 20 and extend upward from the top surface 24 of the base. The top surfaces 50 and 52 of the blocks 46 and 48 have profiles that are the same as the top arcuate surface 40 of adjacent ribs 34. Depressions 54 in the blocks 46 and 48 reduce the weight of the shoulder strap pad 10.

Short binders 56 and 58 are integral with the base 20 and the inboard edge of the blocks 46 and 48. These short binders 56 and 58 are connected to the base 20 and the blocks 46 and 48 by thin webbs 60 and 62 that are integral with the base and the blocks and the short binders. Female portions 64 and 66 of snap connectors are secured to the short binders 56 and 58. Long binders 68 and 70 are integral with the outboard edge of the base 20 and the blocks 46 and 48. These long binders 68 and 70 are connected to the base 20 and the blocks 46 and 48 by thin webbs 72 and 74 that are integral with the base and the blocks and the long binders. The thin webbs 72 and 74 have reduced area hinge sections 76, 78, 80 and 82. Male portions 84 and 86 of snap connectors are secured to the long binders 68 and 70.

The shoulder strap pad 10 is attached to a shoulder strap by laying the strap on the arcuate top surface 40 of the ribs 34 between the inside strap retaining projections 42 and the outside strap retaining projections 44. The long binders 68 and 70 are then folded inward over the shoulder strap. The short binders 56 and 58 are folded inward over the long binders 68 and 70 and the female portions 64 and 66 are pressed into engagement with male portions 84 and 86. In this position the shoulder strap is confined between the top surfaces 50 and 52 of the blocks 46 and 48 and the binders 56, 68 and 58, 70. The snap fasteners described above can be replace by any suitable fastener. The short binders 56 and 58 and the long binders 68 and 70 could also be replaced by another shoulder strap binding system.

A shoulder strap is first bowed about a long axis by the arcuate top surface 40 of each of the ribs 34 when the shoulder strap is attached to the shoulder strap cushion 10. Placing the shoulder strap cushion on a person's shoulder bends the base 20 about a transverse axis that is perpendicular to the long axis of the shoulder strap cushion. As a result, the edges of the shoulder strap support a larger portion of the total load on the shoulder strap and the edges are held in contact with the arcuate top surfaces 40 of the ribs 34 and remain between the projections 42 and 44.

The disclosed embodiments are representative of presently preferred form of the invention, but are intended to be illustrative rather than definitive thereof. The invention is defined in the claims.

I claim:

1. A shoulder strap pad comprising:

a generally rectangular base with an inside edge, an outside edge, a front end, a rear end, a top surface and a bottom surface;

a plurality of spaced apart projections integral with said generally rectangular base, projecting downwardly from the bottom surface and having generally flat free ends;

a plurality of spaced apart ribs integral with said generally rectangular base each of which is perpendicular to the inside edge, projects upward from the top surface of said generally rectangular base, has a short inside height, a tall outside height, an upper rib surface that is concave, an inside strap retaining projection that extends upward from an inside portion of the upper rib surface, and an outside strap retaining projection that extends upward from an outside portion of the upper surface; and at least one shoulder strap pad binder.

2. A shoulder pad as set forth in claim 1 wherein the generally rectangular base, the plurality of spaced apart projections and the plurality of spaced apart ribs are made from a flexible and resilient material.

3. A shoulder strap pad as set forth in claim 1 wherein the generally rectangular base, the plurality of spaced apart projections and the plurality of spaced apart ribs are molded.

4. A shoulder strap pad as set forth in claim 1 wherein at least one shoulder strap pad binder includes a front shoulder strap encircling band and a rear shoulder strap encircling band.

5. A shoulder strap pad as set forth in claim 4 wherein the front shoulder strap encircling band includes a front joint with a front releasable mechanical fastener; and the rear shoulder strap encircling band includes a rear joint with a rear releasable mechanical fastener.

6. A shoulder strap pad as set forth in claim 5 wherein the front shoulder strap encircling band is integral with the front end of the generally rectangular base; and the rear shoulder strap encircling band is integral with the rear end of the generally rectangular base.

7. A shoulder strap pad comprising:

a generally rectangular base with an inside edge, an outside edge, a front end, a rear end, a top surface and a bottom surface;

a front block integral with the front end of the generally rectangular base and extending upward from the top surface;

a rear block integral with the rear end of the generally rectangular base and extending upward from the top surface;

a plurality of spaced apart shoulder engaging projections integral with said generally rectangular base, projecting downward from the bottom surface and having generally flat free ends; and a plurality of spaced apart ribs integral with said rectangular base, positioned between the front block and the rear block and wherein each of the plurality of spaced apart ribs is perpendicular to a center line extending the length of said generally rectangular base, projects upward from the top surface of said generally rectangular base, has a short inside wall, has a tall outside wall, has a concave upper rib surface that is an arc about an arc axis parallel to the center line, and includes an inside strap retaining projection that extends upward from an inside portion of the upper rib surface and an outside strap retaining projection extending upward from an outside portion of the upper rib surface.

8. A shoulder strap pad as set forth in claim 7 including a front shoulder strap binder integral with the front end of the generally rectangular base and having a front joint with a front releasable mechanical fastener; and a rear shoulder strap binder integral with the rear end of the generally rectangular base and having a rear joint with a rear releasable mechanical fastener.

* * * * *